US011670465B2

(12) United States Patent
Lin

(10) Patent No.: US 11,670,465 B2
(45) Date of Patent: Jun. 6, 2023

(54) KEY STRUCTURE

(71) Applicants: LITE-ON ELECTRONICS (GUANGZHOU) LIMITED, Guangzhou (CN); Lite-On Technology Corporation, Taipei (TW)

(72) Inventor: Hsien-Ming Lin, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 410 days.

(21) Appl. No.: 16/695,019

(22) Filed: Nov. 25, 2019

(65) Prior Publication Data

US 2020/0168410 A1 May 28, 2020

(30) Foreign Application Priority Data

Nov. 27, 2018 (CN) ..... 201811424477.7

(51) Int. Cl.
*H01H 13/14* (2006.01)
*H01H 13/10* (2006.01)
*H01H 13/52* (2006.01)

(52) U.S. Cl.
CPC ..... *H01H 13/14* (2013.01); *H01H 13/10* (2013.01); *H01H 13/52* (2013.01); *H01H 2215/042* (2013.01); *H01H 2227/036* (2013.01)

(58) Field of Classification Search
CPC ..... H01H 13/14; H01H 13/10; H01H 13/52; H01H 2215/042; H01H 2227/036; H01H 13/85; H01H 2221/04; H01H 13/84; H01H 36/004; H01H 36/00073; H01H 2036/0093
See application file for complete search history.

(56) References Cited

U.S. PATENT DOCUMENTS 4,054,944 A * 10/1977 Lau ..... H01H 5/02 200/530
6,962,452 B2 * 11/2005 Cheng ..... H01H 13/84 400/479.2

FOREIGN PATENT DOCUMENTS

| | | |
|---|---|---|
| CN | 103762113 | 4/2014 |
| CN | 204464112 | 7/2015 |
| CN | 204537915 | 8/2015 |
| CN | 204668216 | 9/2015 |
| CN | 105206456 | 12/2015 |
| CN | 206758331 | 12/2017 |

(Continued)

OTHER PUBLICATIONS

"Office Action of China Counterpart Application", dated Aug. 30, 2021, p. 1-p. 12.

*Primary Examiner* — Lheiren Mae A Caroc
(74) *Attorney, Agent, or Firm* — JCIPRNET

(57) ABSTRACT

A key structure is provided, including a housing, a shaft body, a first magnetic component and a second magnetic component. The housing has a bottom portion and a top portion which are opposite to each other, and has a first opening located at the top portion. The shaft body is coupled with the housing by passing through the first opening, and the shaft body is suitable for being pressed to move in a pressing direction from the top portion to the bottom portion. The first magnetic component is arranged on the shaft body. The second magnetic component is arranged on the housing. The first magnetic component and the second magnetic component are separated by the housing.

24 Claims, 9 Drawing Sheets

(56) References Cited

FOREIGN PATENT DOCUMENTS

| | | | | | |
|---|---|---|---|---|---|
| CN | 207542122 | | | 6/2018 | |
| CN | 108346540 | | | 7/2018 | |
| GB | 2099762 | A | * | 12/1982 | ..... B41J 5/26 |
| JP | H04179010 | | | 6/1992 | |

* cited by examiner

KEY STRUCTURE

CROSS-REFERENCE TO RELATED APPLICATION

This application claims the priority benefit of China application serial no. 201811424477.7, filed on Nov. 27, 2018. The entirety of the above-mentioned patent application is hereby incorporated by reference herein and made a part of this specification.

BACKGROUND OF THE INVENTION

1. Field of the Invention

The invention generally relates to a mechanical switch structure, in particular, to a key structure.

2. Description of Related Art

Keyboards are one of the most important input units of personal computers, notebook computers and mobile devices. According to key structures of the keyboards, the keyboards can be simply divided into a membrane keyboard and a mechanical keyboard. The membrane keyboard is mainly operated by pressing a rubber cap to turn on a circuit under the rubber cap and therefore generate a keying signal. The membrane keyboard is simple in structure and relatively low in cost, and a membrane circuit thereof is waterproofed due to the integrated design. However, the pressing tactility of the membrane keyboard is provided by the deformation of the rubber cap and a restoring force of the rubber cap, so that the rubber cap would be aged with time to make the durability worse, and further affects the tactility during typing.

On the other hand, in the key structure of the mechanical keyboard, a keycap would drive a shaft body when pressed, so as to turn on a circuit board thereunder to send out a keying signal. The mechanical keyboard is high in accuracy and has no key conflict problem since each key structure is independent. Furthermore, the key structure of the mechanical keyboard can be provided with different keystrokes (i.e., the maximum distance between a pressed key structure and an unpressed key structure) and different click feedbacks, so a user can select a keyboard according to the preference. The restoring force when the key structure is pressed is provided by a spring, and the click feedback can be provided by a relative displacement between a shaft body and the spring. In order to provide a good tactile feel for a user, the key structure is generally relatively thick and occupies a large space, which is not conducive to the development of ultra-thin designs.

SUMMARY OF THE INVENTION

The invention provides a key structure, which may provide different keystrokes, lower the entire height of the key structure and provide different click feedbacks. Therefore, the key structure may provide a relatively good pressing tactile feel. Furthermore, the key structure has the advantage of high durability, so that the manufacturing cost can be further reduced.

The embodiment of the invention provides a key structure. The key structure comprises a housing, a shaft body, a first magnetic component and a second magnetic component. The housing has a bottom portion and a top portion which are opposite to each other, and has a first opening located at the top portion. The shaft body is coupled with the housing by passing through the first opening, and the shaft body is suitable for being pressed to move in a pressing direction from the top portion to the bottom portion. The first magnetic component is arranged on the shaft body. The second magnetic component is arranged on the housing. The first magnetic component and the second magnetic component are respectively located on the inner side and the outer side of the housing.

The embodiment of the invention provides a key structure. The key structure comprises a housing, a shaft body, a first magnetic component and a second magnetic component. The housing has a bottom portion and a top portion which are opposite to each other, and has a first opening located at the top portion. The shaft body is coupled with the housing by passing through the first opening, and the shaft body is suitable for being pressed to move in a pressing direction from the top portion to the bottom portion. The first magnetic component is arranged on the shaft body. The second magnetic component is arranged on the housing. The first magnetic component and the second magnetic component are aligned in an arrangement direction when the shaft body is not pressed, and an included angle between the arrangement direction and the pressing direction is greater than 0 degree and less than 180 degrees.

The embodiment of the invention provides a key structure. The key structure comprises a housing, a shaft body, a first magnetic component and a second magnetic component. The housing has a bottom portion and a top portion which are opposite to each other, and has a first opening located at the top portion. The shaft body is coupled with the housing by passing through the first opening, and the shaft body is suitable for being pressed to move in a pressing direction from the top portion to the bottom portion. The first magnetic component is arranged on the shaft body. The second magnetic component is arranged on the housing. When the shaft body is not pressed, the upper edge of the first magnetic component is higher than the upper edge of the second magnetic component, and when the shaft body is pressed to the bottom, the upper edge of the first magnetic component is lower than the upper edge of the second magnetic component.

The embodiment of the invention provides a key structure. The key structure comprises a housing, a shaft body, a first magnetic component and a second magnetic component. The housing has a bottom portion and a top portion which are opposite to each other, and has a first opening located at the top portion. The shaft body is coupled with the housing by passing through the first opening, and the shaft body is suitable for being pressed to move in a pressing direction from the top portion to the bottom portion. The first magnetic component is arranged on the shaft body. The second magnetic component is arranged on the housing. The second magnetic component applies a magnetic repulsive force component in a release direction to the first magnetic component to provide a restoring force in the release direction to the shaft body, wherein the release direction is opposite to the pressing direction.

Based on the above, the key structure in the embodiment of the invention includes the first magnetic component and the second magnetic component, and the second magnetic component applies the magnetic force component in the release direction to the first magnetic component, so that the magnetic force component provides the restoring force in the release direction to the shaft body. Therefore, the key structure of the embodiment of the invention may provide different keystrokes and lower the entire height of the key structure. In addition, the key structure may provide different click feedbacks. Therefore, the key structure may provide a good pressing tactile feel. Furthermore, the key structure has the advantage of high durability, so that the manufacturing cost can be further reduced.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1A:
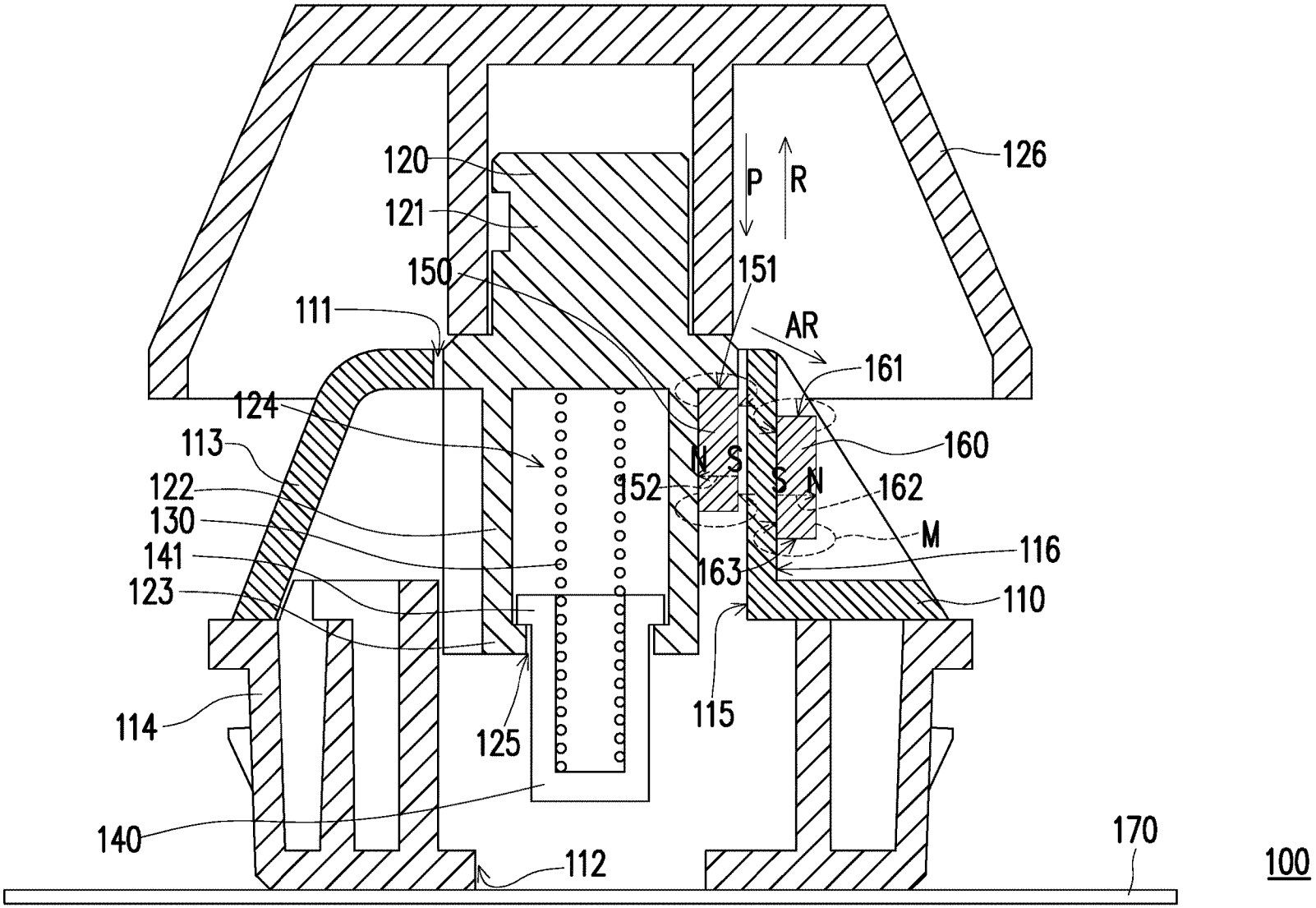
FIG. 1A is a cross-sectional schematic diagram of a key structure according to one embodiment of the invention.

FIG. 1A is a cross-sectional schematic diagram of a key structure according to one embodiment of the invention. It should be noted here that the key structure of the embodiment of the invention is one of keys applied to an input unit (such as a keyboard) of an electronic device such as a computer, so as to trigger a specific signal. Referring to FIG. 1A, the key structure 100 of the present embodiment includes a housing 110, a shaft body 120, a first magnetic component 150 and a second magnetic component 160. The housing 110 has a bottom portion 114 and a top portion 113 which are opposite to each other, and has a first opening 111 located at the top portion 113. The bottom portion 114 and the top portion 113 are, for example, connected to each other, and define a hollow receiving space to receive the shaft body 120. The shaft body 120 is coupled with and assembled on the housing 110 by passing through the first opening 111, and the shaft body 120 is suitable for being pressed to move in a pressing direction P from the top portion 113 to the bottom portion 114. The first magnetic component 150 is arranged on the shaft body 120. The second magnetic component 160 is arranged on the housing 110. The first magnetic component 150 and the second magnetic component 160 are separated by the housing 110. In particular, the first magnetic component 150 and the second magnetic component 160 are respectively located on the inner side 115 and the outer side 116 of the housing 110, and the second magnetic component 160 applies a magnetic force component (which could be represented by magnetic force lines M generated between the first magnetic component 150 and the second magnetic component 160) in a release direction R to the first magnetic component 150 to provide a restoring force in the release direction R to the shaft body 120. The release direction R is opposite to the pressing direction P. In another embodiment, the first magnetic component 150 and the second magnetic component 160 may also be arranged on the inner side 115 of the housing 110 under the permission of the receiving space.

Specifically, the first magnetic component 150 and the second magnetic component 160 of the embodiment of the invention are aligned in an arrangement direction AR when the shaft body 120 is not pressed, and an included angle between the arrangement direction AR and the pressing direction P is greater than 0 degree and less than 180 degrees. The arrangement direction AR is, for example, a direction from the upper edge 151 of the first magnetic component 150 to the upper edge 161 of the second magnetic component 160.

Figure 1B:
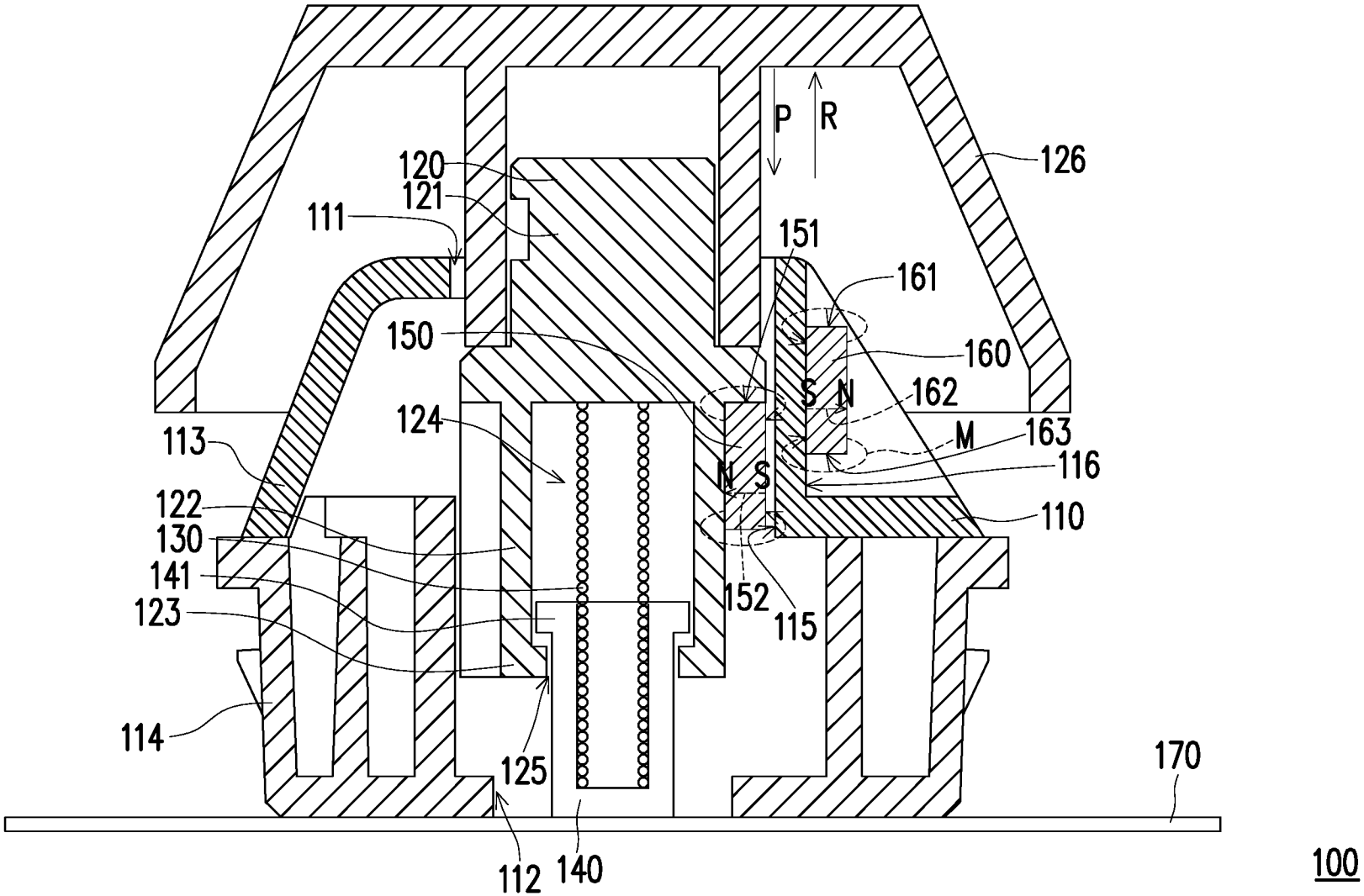
FIG. 1B is a schematic diagram of the key structure of FIG. 1A after the key structure is pressed.

FIG. 1B is a schematic diagram of the key structure of FIG. 1A after the key structure is pressed. Referring to FIGS. 1A and 1B at the same time, when the shaft body 120 is not pressed, the upper edge 151 of the first magnetic component 150 is positioned higher than the upper edge 161 of the second magnetic component 160, and when the shaft body 120 is pressed to the bottom, the upper edge 151 of the first magnetic component 150 is positioned lower than the upper edge 161 of the second magnetic component 160. In one embodiment of the invention, when the shaft body 120 is pressed to the bottom, the upper edge 151 of the first magnetic component 150 is positioned higher than the lower edge 163 of the second magnetic component 160; or in another embodiment of the invention, when the shaft body 120 is pressed to the bottom, the upper edge 151 of the first magnetic component 150 may be positioned lower than the center of the second magnetic component 160.

In the present embodiment, the shaft body 120 passing through the first opening 111 has an upper end 121 positioned higher than the top portion 113, a lower end 123 positioned lower than the top portion 113, and a sidewall 122 connecting the upper end 121 with the lower end 123. The first magnetic component 150 is arranged on the sidewall 122 of the shaft body 120, and the first magnetic component 150 is located between the second magnetic component 160 and the sidewall 122. For example, when the key structure 100 is not pressed, the upper end 121 of the shaft body 120 at least partially protrudes from the first opening 111 and is located outside the housing 110, and the lower end 123 is accommodated in the housing 110.

In the present embodiment, the magnetic force component in the release direction R, applied by the second magnetic component 160 to the first magnetic component 150, is a magnetic repulsive force component. That is, a magnetization direction 152 of the first magnetic component 150 is opposite to a magnetization direction 162 of the second magnetic component 160. As depicted in FIG. 1A, like magnetic poles, e.g., the south poles S, of the first magnetic component 150 and the second magnetic component 160 face each other, so that the magnetic force component between the first magnetic component 150 and the second magnetic component 160 is the magnetic repulsive force component.

In other embodiments, the first magnetic component 150 and the second magnetic component 160 may be orientated with their north poles N facing each other to generate the magnetic repulsive force component; or the first magnetic component 150 and the second magnetic component 160 may be orientated with ones north pole N facing the other's south pole S to generate a magnetic attractive force component (that is, the magnetization direction 152 of the first magnetic component 150 is the same as the magnetization direction 162 of the second magnetic component 160). In an embodiment, the magnetization direction 152 of the first magnetic component 150 and the magnetization direction 162 of the second magnetic component 160 are the same as the pressing direction P. Alternatively, the magnetization direction 152 of the first magnetic component 150 is the same as the pressing direction P, but the magnetization direction 162 of the second magnetic component 160 is opposite to the pressing direction P.

In addition, an included angle between the magnetization direction 152 of the first magnetic component 150 and the pressing direction P is greater than 0 degree and less than 180 degrees, and an included angle between the magnetization direction 162 of the second magnetic component 160 and the pressing direction P is greater than 0 degree and less than 180 degrees. In the present embodiment, as shown in FIG. 1A, the included angle between the magnetization direction 152 of the first magnetic component 150 and the pressing direction P is about 90 degrees, and the included angle between the magnetization direction 162 of the second magnetic component 160 and the pressing direction P is about 90 degrees.

Referring to FIGS. 1A and 1B again, the housing 110 of the present embodiment further has a second opening 112 located at the bottom portion 114. The upper end 121, the lower end 123 and the sidewall 122 of the shaft body 120 are disposed around a receiving portion 124, and the receiving portion 124 has a third opening 125 towards the second opening 112. That is, an opening direction of the third opening 125 of the receiving portion 124 of the shaft body 120 is towards the pressing direction P. In one embodiment, the first opening 111, the second opening 112 and the third opening 125 are aligned, for example, in the pressing direction P.

Furthermore, the key structure 100 further includes a keycap 126, a circuit board 170, a rod piece 140 and an elastic component 130. The keycap 126 is arranged on the housing 110 and connected to the upper end 121 of the shaft body 120. One end of the housing 110 at the bottom portion 114 is arranged on the circuit board 170. In one embodiment, the circuit board 170 may be a membrane circuit board or a rigid circuit board. The rod piece 140 has a stop portion 141. The rod piece 140 is engaged with and assembled on the shaft body 120 by passing through the third opening 125 of the shaft body 120, and one end of the rod piece 140 protrudes from the third opening 125 of the receiving portion 124 of the shaft body 120. The elastic component 130 is arranged in the receiving portion 124 of the shaft body 120. One end of the elastic component 130 is connected with the receiving portion 124 of the shaft body 120, and the other end of the elastic component 130 is connected with the rod piece 140. When the shaft body 120 is not pressed, the rod piece 140 is, for example, spaced from the circuit board 170 at a certain distance without contact. Under the elastic force of the elastic component 130, when the rod piece 140 is not in contact with the circuit board 170, the stop portion 141 abuts on the lower end 123 of the shaft body 120. When the shaft body 120 is pressed, the end, protruding from the third opening 125 of the receiving portion 124 of the shaft body 120, of the rod piece 140 passes through the second opening 112 of the housing 110 to touch or be in contact with the circuit board 170, and thereby the circuit board 170 generates a keying signal. Meanwhile, the elastic component 130 generates an elastic deformation force, and the direction in which the elastic deformation force is applied to the shaft body 120 is the same as the release direction R. In an embodiment, the elastic deformation force of the elastic component 130 is applied to the shaft body 120 in a direction parallel to the release direction R. Once the shaft body 120 is no longer pressed, this elastic deformation force may serve as an initial restoring force for allowing the shaft body 120 to return to the unpressed position. The elastic component 130 is, for example, a spring, but the invention is not limited thereto.

It should be noted that when the shaft body 120 is not pressed or is pressed and then released, the shaft body 120 abuts on the housing 110. Specifically, a limiting portion may be arranged on at least one of the housing 110 and the shaft body 120. For example, the housing 110 and the shaft body 120 may each be provided with a limiting portion in a direction perpendicular to the cross section of FIG. 1A, so that when the shaft body 120 is not pressed or is pressed and then released, the relative positions of the shaft body 120 and the housing 110 are limited by the limiting portions. That is, the shaft body 120 abuts on the upper part of the housing 110, and the shaft body 120 is thus unlikely to move further upward and entirely pop out of the housing 110.

Based on the above, the key structure 100 in one embodiment of the invention is high in durability by the use of the first magnetic component 150, the second magnetic component 160 and the elastic component 130 to generate the restoring force. Furthermore, the housing 110, shaft body 120, elastic component 130 or rod piece 140 could be selected and assembled based on the needs, thereby allowing the key structure 100 to have different keystrokes and lower the entire height of the key structure 100. In addition, in the present embodiment, the key structure 100 could be waterproofed by the use of the membrane circuit board to generate the keying signal. Furthermore, the design of the key structure 100 of the present embodiment is relatively simple, so that the manufacturing cost of the key structure 100 can be further reduced.

Figure 2A:
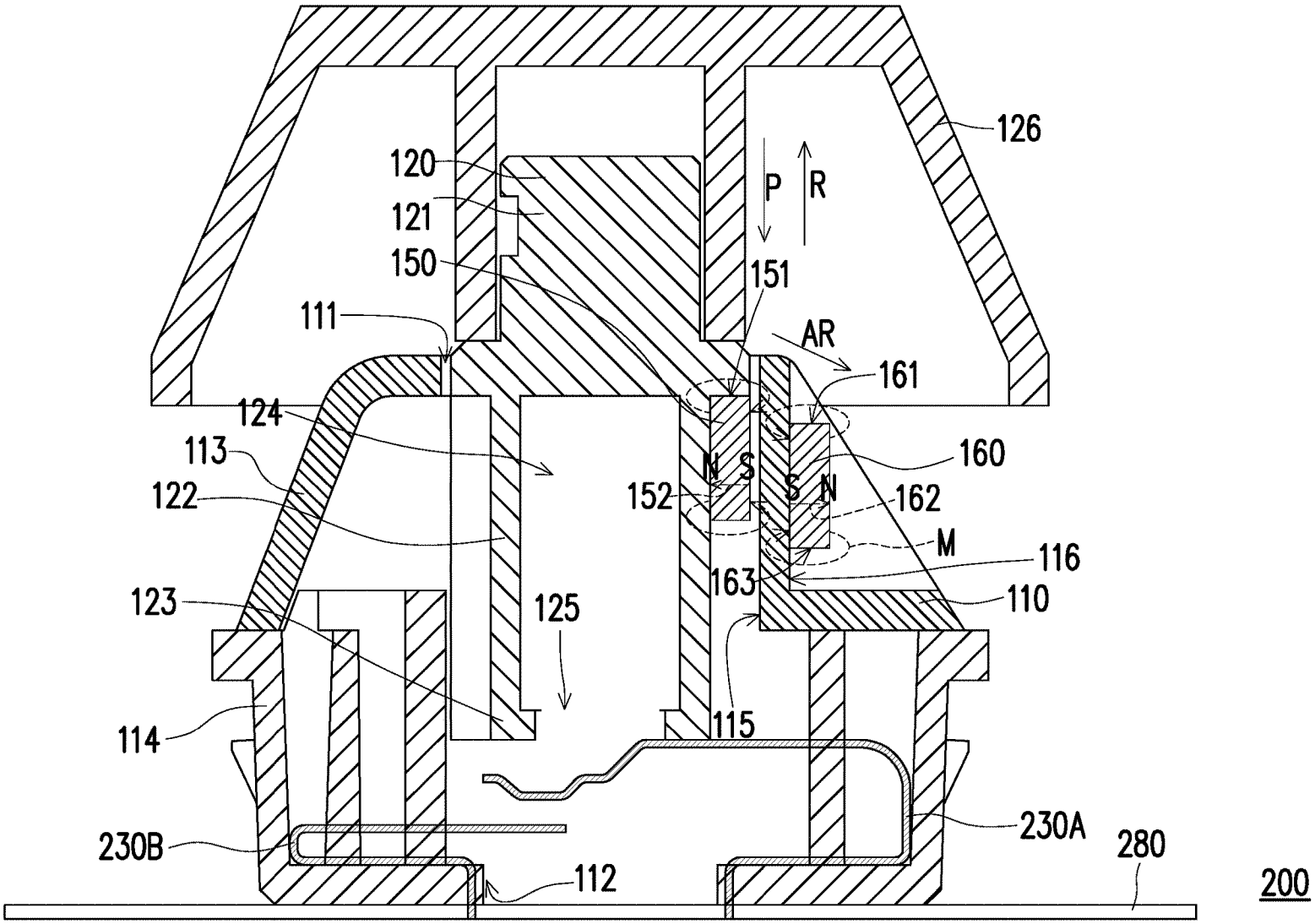
FIG. 2A is a cross-sectional schematic diagram of a key structure according to another embodiment of the invention.
Figure 2B:
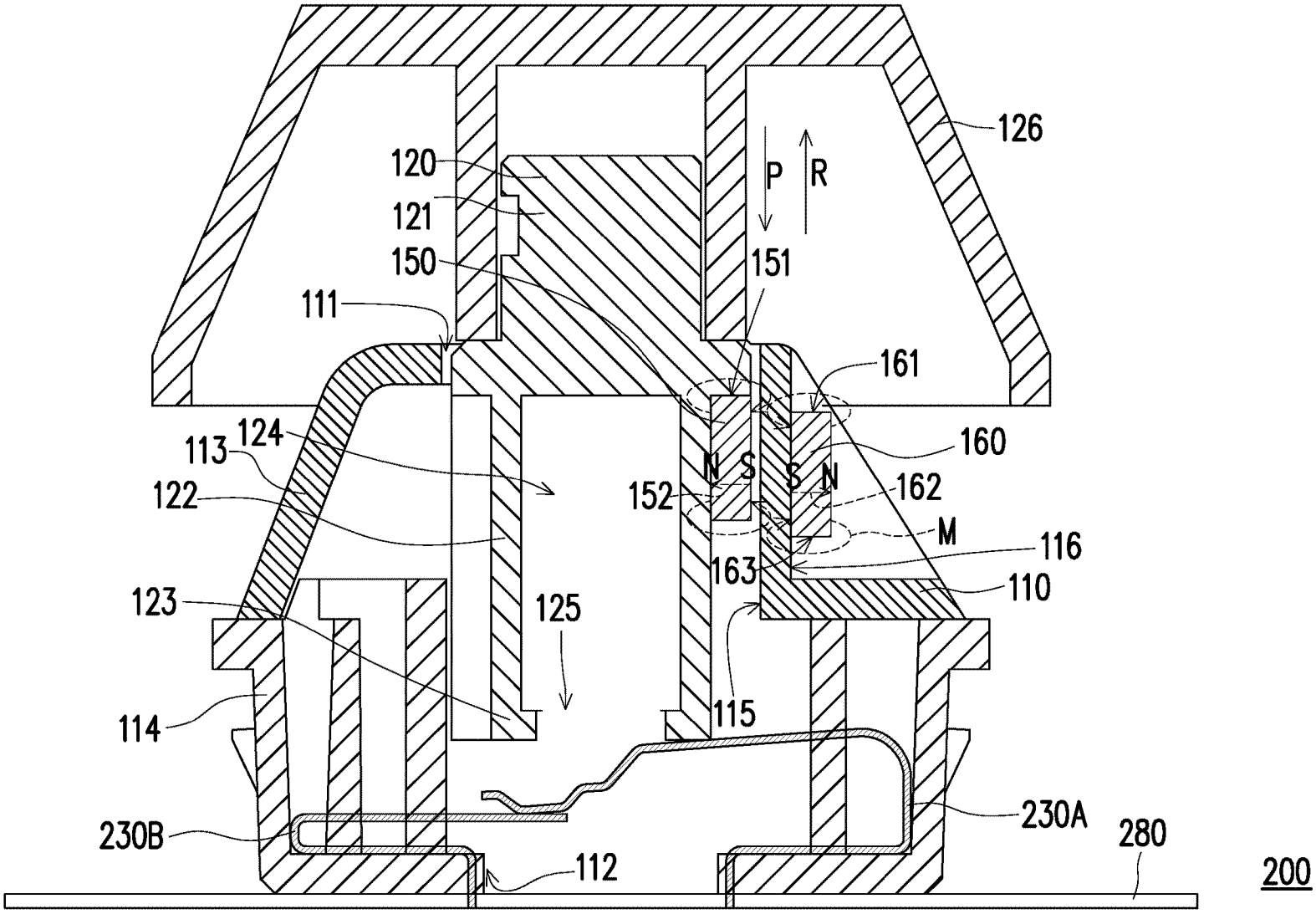
FIG. 2B is a schematic diagram of the key structure of FIG. 2A after the key structure is pressed.

FIG. 2A is a cross-sectional schematic diagram of a key structure according to another embodiment of the invention, and FIG. 2B is a schematic diagram of the key structure of FIG. 2A after the key structure is pressed. Referring to FIGS. 2A and 2B, the key structure 200 of FIGS. 2A and 2B has similar features to the key structure 100 of FIGS. 1A and 1B, and the same elements will not be described again. In the present embodiment, the key structure 200 further includes a keycap 126, a circuit board 280, an elastic component 230A and a conductive structure 230B. The keycap 126 is arranged at the upper end 121 of the shaft body 120. One end of the housing 110 at the bottom portion 114 is arranged on the circuit board 280. The circuit board 280 is, for example, a membrane circuit board or a rigid circuit board. The elastic component 230A and the conductive structure 230B are individually arranged in the housing 110, and respectively have pins electrically connected to the circuit board 280. The elastic component 230A is arranged on the bottom portion 114 of the housing 110 and abuts on the lower end 123 of the shaft body 120. The conductive structure 230B is arranged on the bottom portion 114 of the housing 110. When the shaft body 120 is not pressed, the elastic component 230A and the conductive structure 230B are separated from each other without electrical conduction. When the shaft body 120 is pressed, the elastic component 230A that abuts on the lower end 123 is thus pressed to deform and touch the conductive structure 230B to generate electrical conduction, so that the circuit board 280 generates a keying signal. At the moment, the pressed elastic component 230A generates an elastic deformation force, and the elastic deformation force from the pressed elastic component 230A is applied to the shaft body 120 in a direction parallel to the release direction R, i.e., the direction in which the elastic deformation force is applied to the shaft body 120 is the same as the release direction R. In the present embodiment, the elastic component 230A could be a metal elastic sheet or plate, but the invention is not limited thereto.

It should be noted that a limiting portion may be arranged on at least one of the housing 110 and the shaft body 120 of the key structure 200 in the present embodiment. For example, the housing 110 and the shaft body 120 may each be provided with a limiting portion in a direction perpendicular to the cross section of FIG. 2A, so that when the shaft body 120 is not pressed or is pressed and then released, the relative positions of the shaft body 120 and the housing 110 are limited by the limiting portions, that is, the shaft body 120 abuts on the upper part of the housing 110. Referring to FIGS. 2A and 2B at the same time, when the shaft body 120 is not pressed, the upper edge 151 of the first magnetic component 150 is positioned higher than the upper edge 161 of the second magnetic component 160, as shown in FIG. 2A, and when the shaft body 120 is pressed to the bottom, the upper edge 151 of the first magnetic component 150 is still positioned higher than the upper edge 161 of the second magnetic component 160, as shown in FIG. 2B. However, in another embodiment, when the shaft body 120 is pressed to the bottom, the upper edge 151 of the first magnetic component 150 may be positioned lower than the upper edge 161 of the second magnetic component 160.

In addition, the key structure 200 of FIG. 2A has a second opening 112, but the invention is not limited thereto. For the key structure 200, the elastic component 230A and the conductive structure 230B are in contact with each other to enable the circuit board 280 to generate a keying signal, so that the key structure 200 may still generate the keying signal without the second opening 112.

Based on the above, the key structure 200 in one embodiment of the invention is high in durability by the use of the first magnetic component 150, the second magnetic component 160 and the elastic component 230A to generate the restoring force. In addition, the housing 110, shaft body 120, elastic component 230A or conductive structure 230B may be provided with different sizes to obtain various combination of the key structure 200, or the inter-contact positions of the elastic component 230A and the conductive structure 230B could be adjusted to allow the key structure 200 to have different keystrokes and lower the entire height of the key structure 200. Furthermore, the design of the key structure 200 of the present embodiment is relatively simple, so that the manufacturing cost of the key structure 200 can be further reduced.

Figure 3A:
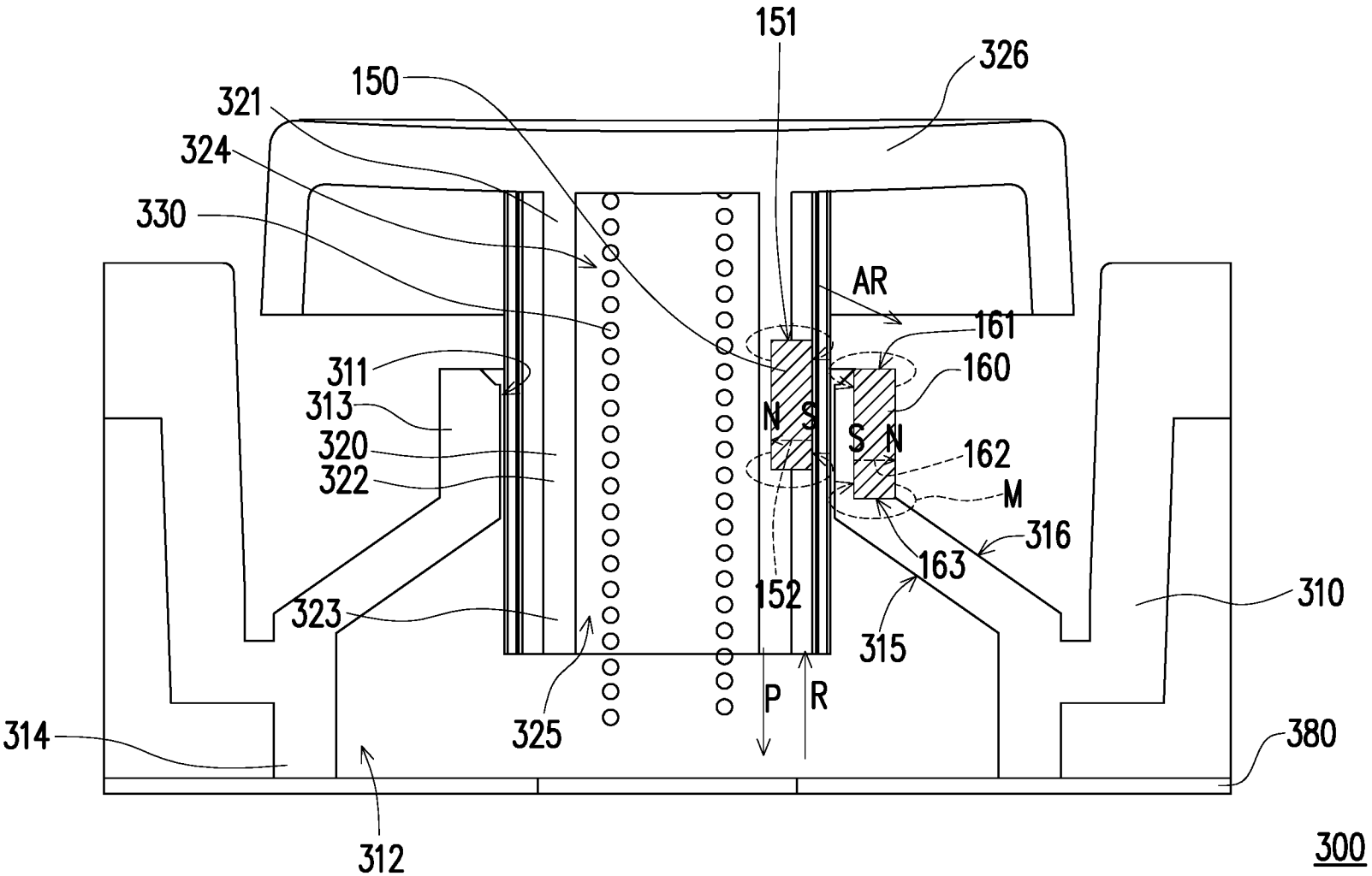
FIG. 3A is a cross-sectional schematic diagram of a key structure according to a further embodiment of the invention.
Figure 3B:
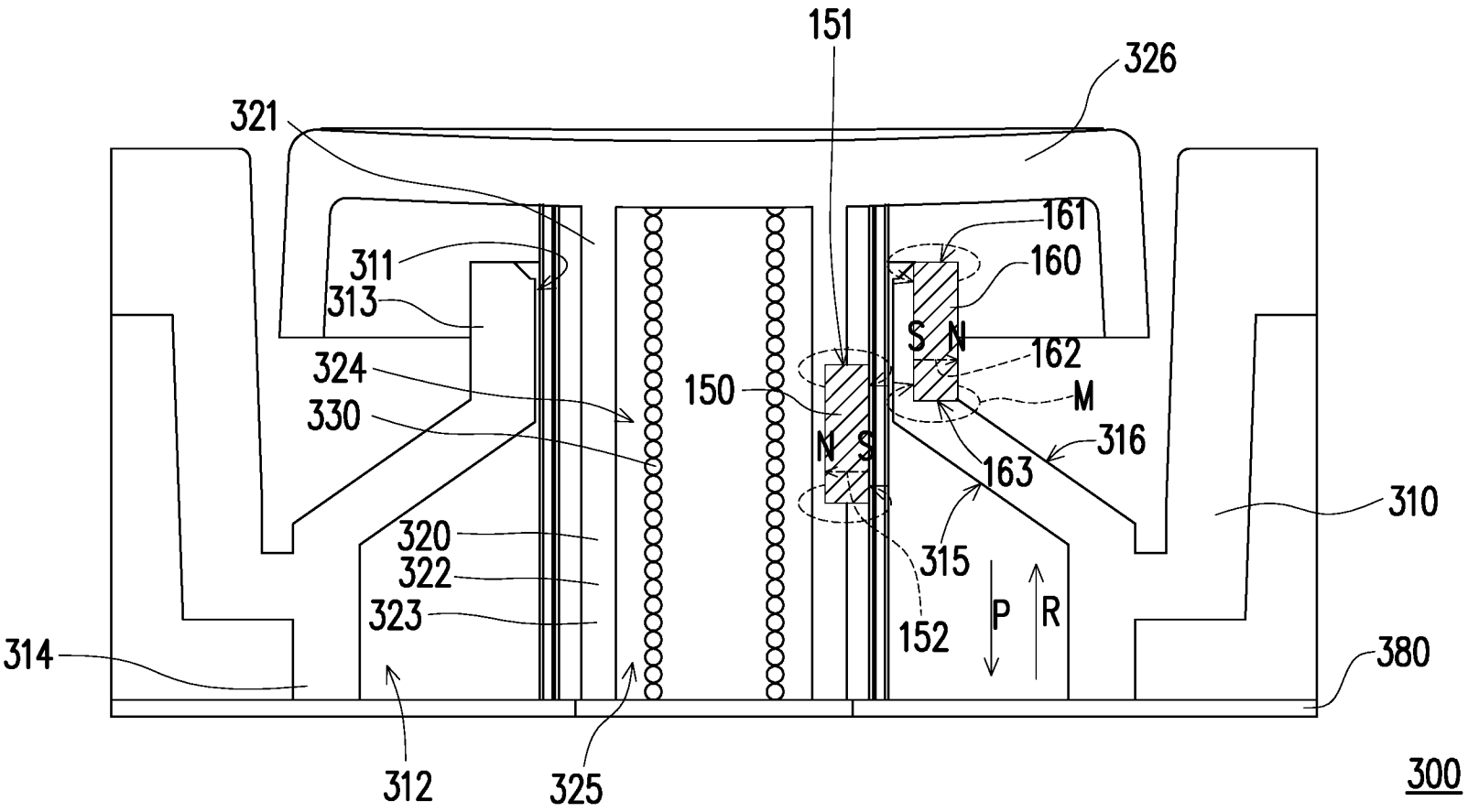
FIG. 3B is a schematic diagram of the key structure of FIG. 3A after the key structure is pressed.

FIG. 3A is a cross-sectional schematic diagram of a key structure according to a further embodiment of the invention, and FIG. 3B is a schematic diagram of the key structure of FIG. 3A after the key structure is pressed. Referring to FIGS. 3A and 3B, the key structure 300 of FIGS. 3A and 3B has similar features to the key structure 100 of FIGS. 1A and 1B, and the same elements will not be described again. In the above embodiment, a plurality of key structures 100 are, for example, individually arranged as a single unit. In the present embodiment, a plurality of key structures 300 share, for example, a common frame or cover which is namely a housing 310. The key structure 300 further includes a keycap 326, a circuit board 380 and an elastic component 330. The keycap 326 is arranged at the upper end 321 of the shaft body 320. The keycap 326 and the shaft body 320 could be integrally formed in one piece. One end of the housing 310 at the bottom portion 314 is arranged on the circuit board 380. The elastic component 330 is arranged in the receiving portion 324 of the shaft body 320. One end of the elastic component 330 is connected into the receiving portion 324 of the shaft body 320, and the other end of the elastic component 330 protrudes from the third opening 325 of the receiving portion 324 of the shaft body 320. When the shaft body 320 is not pressed, the elastic component 330 and the lower end 323 of the shaft body 320 would not touch the circuit board 380. When the shaft body 320 is pressed, the end, protruding from the third opening 325 of the receiving portion 324 of the shaft body 320, of the elastic component 330 would pass through the second opening 312 of the housing 310 to be in contact with the circuit board 380, and the circuit board 380 thus generates a keying signal. The pressed elastic component 330 may generate an elastic deformation force, and the direction in which the elastic deformation force is applied to the shaft body 320 is the same as or parallel to the release direction R. In the present embodiment, the elastic component 330 is, for example, a spring, but the invention is not limited thereto.

In another embodiment of the invention, the circuit board 380 may be a membrane circuit board or a rigid circuit board. When the membrane circuit board is used, a bottom plate (not shown) may be arranged under the circuit board 380 to support the membrane circuit board.

It should be noted that a limiting portion may be arranged on at least one of the housing 310 and the shaft body 320 of the key structure 300 of the present embodiment. For example, the housing 310 and the shaft body 320 may each be provided with a limiting portion in a direction perpendicular to the cross section of FIG. 3A, so that when the shaft body 320 is not pressed or is pressed and then released, the relative positions of the shaft body 320 and the housing 310 are limited by the limiting portions, that is, the shaft body 320 abuts on the upper part of the housing 310.

In addition, in the present embodiment, the housing 310 is a frame of a keyboard. The frame has a plurality of first openings 311, and a plurality of shaft bodies 320 are assembled on the frame by passing through the first openings 311, respectively. However, the invention is not limited thereto, and the frame may be an integrally-formed frame or cover.

Based on the above, the key structure 300 in one embodiment of the invention is high in durability by the use of the first magnetic component 150, the second magnetic component 160 and the elastic component 330 to generate the restoring force. In addition, housing 310, shaft body 320 or elastic component 330 may be provided with various combinations to allow the key structure 300 to have different keystrokes and lower the entire height of the key structure 300. Furthermore, the design of the key structure 300 of the present embodiment is relatively simple, so that the manufacturing cost of the key structure 300 can be further reduced. In another embodiment, the key structure 300 may use a membrane circuit board to generate a keying signal, and thus is waterproofed.

Figure 4B:
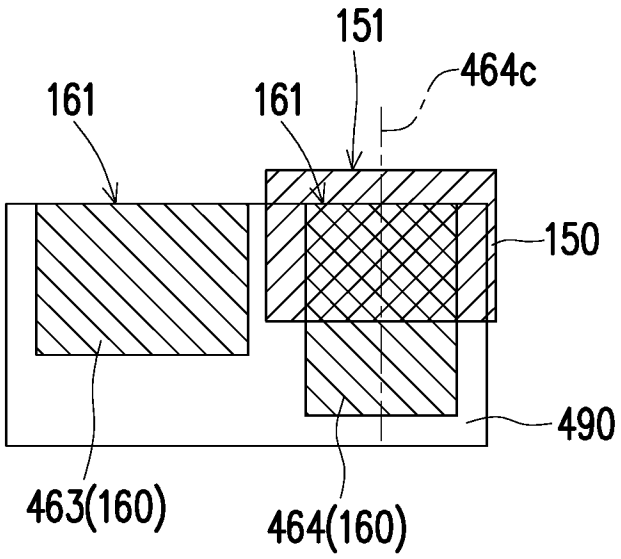
FIGS. 4A and 4B are respectively exemplary embodiments illustrating that a center line of a first magnetic subunit and a center line of a second magnetic subunit are overlapped on a first magnetic component.
Figure 4A:
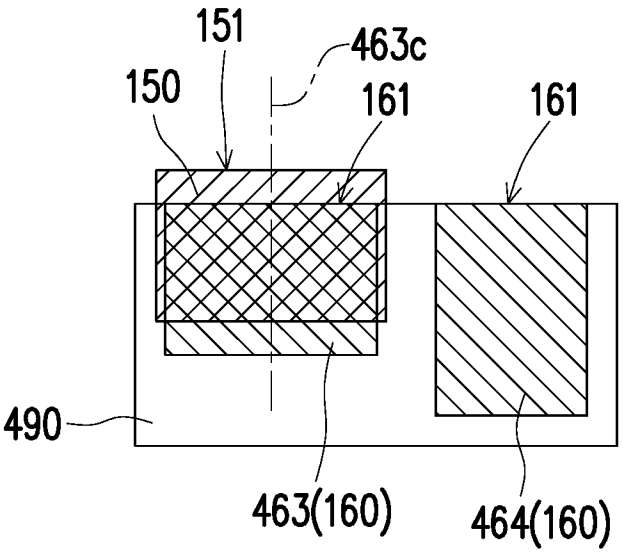
Figure 5:
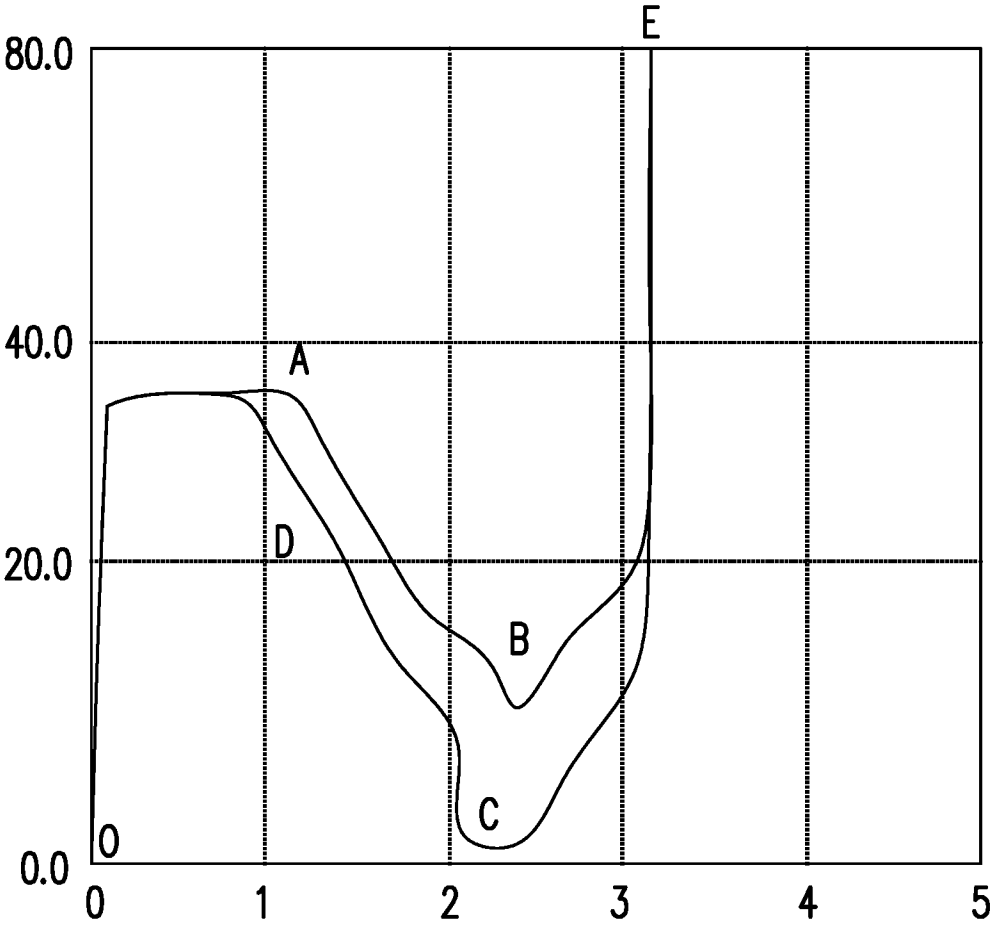
FIG. 5 is a force-displacement curve of the key structure in an embodiment of the invention when the center line of the first magnetic subunit is overlapped on the first magnetic component.
Figure 6:
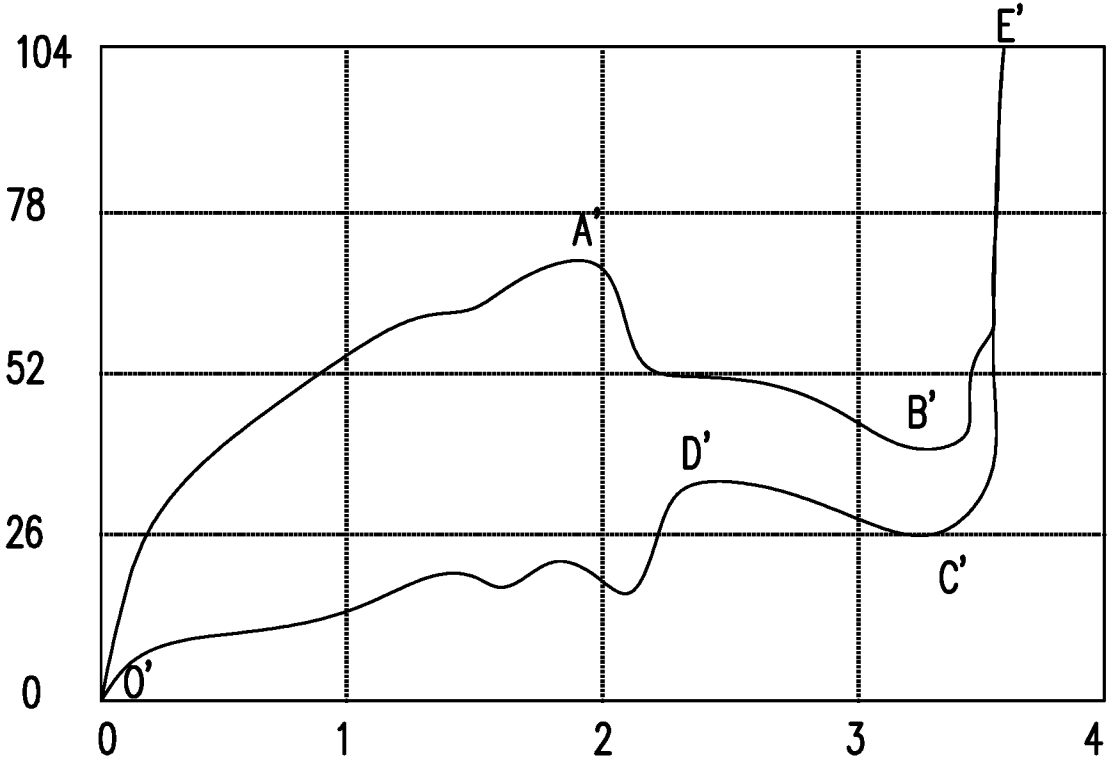
FIG. 6 is a force-displacement curve of the key structure in an embodiment of the invention when the center line of the second magnetic subunit is overlapped on the first magnetic component.

FIGS. 4A and 4B are respectively exemplary embodiments illustrating that a center line of a first magnetic subunit and a center line of a second magnetic subunit are overlapped on a first magnetic component. FIG. 5 is a force-displacement curve of the key structure in an embodiment of the invention when the center line of the first magnetic subunit is overlapped on the first magnetic component. FIG. 6 is a force-displacement curve of the key structure in an embodiment of the invention when the center line of the second magnetic subunit is overlapped on the first magnetic component.

The pressed key structures in the above embodiments of the invention may further provide a click feedback from the magnetic force component in the release direction by the second magnetic component to the first magnetic component. Specifically, referring to FIGS. 4A and 4B, the second magnetic component 160 includes a first magnetic subunit 463, a second magnetic subunit 464 and a switch 490. The first magnetic subunit 463 and the second magnetic subunit 464 are fixedly arranged on the switch 490, and the switch 490 is arranged on the housing 110. The switch 490 is configured to enable the first magnetic subunit 463 and the second magnetic subunit 464 to move relative to the first magnetic component 150, so that the center line 463*c* of the first magnetic subunit 463 is overlapped on the first magnetic component 150 or the center line 464*c* of the second magnetic subunit 464 is overlapped on the first magnetic component 150.

Furthermore, a click ratio provided by the key structure 100 in a state that the center line 463*c* of the first magnetic subunit 463 is overlapped on the first magnetic component 150 is greater than that provided by the key structure 100 in a state that the center line 464*c* of the second magnetic subunit 464 is overlapped on the first magnetic component 150. The click ratio provided by the key structure 100 is the percentage of $(F_A-F_B)/F_A$, where $F_B$ is the contact force, and $F_A$ is the actuation force. Specifically, $F_B$ is a local minimum value of a pressing force under different keystrokes when the key structure 100 is pressed and $F_A$ is a peak value of the pressing force under different keystrokes before the local minimum value is reached when the key structure is pressed. The pressing force is a force required for maintaining a key position of the key structure when the key structure is pressed. The keystroke is a distance between a key position of the key structure that is pressed and maintained thereat and a key position of the key structure that is not pressed, e.g., the travel distance of the key structure. That is, $F_B$ is the local minimum value of the pressing force in the force-displacement curve when the key structure 100 is pressed, and $F_A$ is the peak value of the pressing force in the force-displacement curve when the key structure is pressed before the keystroke corresponding to the local minimum value is reached.

For example, the key structure 100 provides a click feedback (which may be described by the click ratio) when the shaft body 120 is pressed, which may be simply illustrated by the force-displacement curve of the key structure. Referring to FIG. 5, the horizontal axis of FIG. 5 is the keystroke, namely the distance between the key position of the key structure that is pressed and the key position of the key structure that is not pressed, and the unit thereof is millimeter (mm). The vertical axis of FIG. 5 is the pressing force, that is, how much force is needed to press the key structure 100 to enable the magnetic force component of the key structure 100 and the elastic deformation force (there is also a contact force provided by the limiting portions if the shaft body 120 abuts on the upper portion of the housing 110) to balance the pressing force, so as to enable the key structure 100 to be fixed at the key position, and the unit thereof is gram (g).

In FIG. 5, the point O is a start point, namely a key position where the key structure is not pressed. When the key structure begins to be pressed, the pressing force may be increased as the keystroke increases. When the keystroke reaches the point A, the pressing force has the peak value $F_A$ in the force-displacement curve. When the keystroke exceeds the point A, the pressing force may be decreased rapidly as the keystroke increases. When the keystroke reaches the point B, the pressing force has the local minimum value $F_B$ in the force-displacement curve. Furthermore, when the keystroke exceeds the point B and continues to reach the point E, the keystroke reaches the maximum value. When the key structure is released and therefore returns to its neutral position, the force-displacement curve will sequentially pass through the point C and the point D, and then return to the point O.

Generally, the fall in the amount between the point A and the point B in the force-displacement curve may affect the operation tactility of the key structure. Therefore, the click ratio can be defined as $$(F_A-F_B)/F_A\times 100\%$$

where $F_A$ and $F_B$ are respectively the pressing forces at the point A and the point B. In an embodiment of the invention, the click ratio is about 40 to 80 percent.

For example, referring to FIGS. 4A and 5, in the present embodiment, when the center line 463*c* of the first magnetic subunit 463 is overlapped on the first magnetic component 150, the click ratio of the key structure is about 71.4%. Therefore, the key structure has a good click feedback when pressed.

Referring to FIGS. 4B and 6 again, in the present embodiment, when the center line 464*c* of the second magnetic subunit 464 is overlapped on the first magnetic component 150, the click ratio of the key structure is about 43.8%. Therefore, the key structure has a relatively unobvious click feedback when pressed. In the present embodiment, since the value of the click ratio is relatively low, it is difficult for a user to have the click feedback.

It should be noted that when the shaft body 120 is not pressed, the upper edge 151 of the first magnetic component 150 is higher than the upper edge 161 of the second magnetic component 160, and when the shaft body 120 is pressed to the bottom, the upper edge 151 of the first magnetic component 150 is lower than the upper edge 161 of the second magnetic component 160. The invention is not limited thereto. In other embodiments, when the shaft body 120 is not pressed, the upper edge 151 of the first magnetic component 150 may also be lower than the upper edge 161 of the second magnetic component 160. The difference is that the click ratios respectively provided by the pressed key structures are different. Therefore, by adjusting a positioning relation between the upper edge 151 of the first magnetic component 150 and the upper edge 161 of the second magnetic component 160 when the shaft body 120 is not pressed, the key structures of the embodiments of the invention may have different click feedbacks during pressing.

Based on the above, the key structures in the embodiments of the invention are high in durability by the use of the first magnetic component, the second magnetic component and the elastic component to generate the restoring force. Furthermore, housings, shaft bodies, elastic components, rod pieces, first magnetic components or second magnetic components may be provided in different configurations or combinations, or the positioning relation between the upper edge of the first magnetic component and the upper edge of the second magnetic component may be adjusted, or the orientation of magnetic poles for the first magnetic component and the second magnetic component may be adjusted, or a magnetic force ratio of the first magnetic component to the second magnetic component may be adjusted, so as to enable the key structure to have different keystrokes and different click feedbacks (which may be described by the click ratio). In an embodiment of the invention, the intercontact positions of the elastic component and the conductive structure may be adjusted to enable the key structure to have different keystrokes and lower the entire height of the key structure. Therefore, the key structure may provide a good tactile feel. In addition, in another embodiment of the invention, the key structure could be waterproofed by the use of the membrane circuit board. Furthermore, the design of the key structure of the embodiment is relatively simple, so that the manufacturing cost can be further reduced.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A key structure, comprising:

a housing, comprising a bottom portion and a top portion which are opposite to each other, and a first opening located at the top portion;

a shaft body, coupled with the housing through the first opening, wherein the shaft body is suitable for being pressed to move in a pressing direction;

a first magnetic component, arranged on the shaft body; and a second magnetic component, arranged on the housing, wherein the first magnetic component and the second magnetic component are separated by the housing, the first magnetic component is arranged on a sidewall of the shaft body, and the first magnetic component is located between the second magnetic component and the sidewall.

2. The key structure according to claim 1, wherein the second magnetic component applies a magnetic force component in a release direction to the first magnetic component to provide a restoring force to the shaft body, and the release direction is opposite to the pressing direction.

3. The key structure according to claim 2, wherein the shaft body comprises an upper end positioned higher than the top portion, a lower end positioned lower than the top portion, and the sidewall for connecting the upper end with the lower end.

4. The key structure according to claim 3, wherein the housing further comprises a second opening located at the bottom portion; the upper end, the lower end and the sidewall of the shaft body are disposed around a receiving portion; and the receiving portion of the shaft body has a third opening towards the second opening.

5. The key structure according to claim 4, further comprising:

a circuit board, wherein one end of the housing is arranged on the circuit board;

a rod piece, comprising a stop portion, wherein the rod piece is engaged with the shaft body by passing through the third opening of the shaft body, and one end of the rod piece protrudes from the third opening of the receiving portion of the shaft body; and an elastic component, arranged in the receiving portion of the shaft body, wherein one end of the elastic component is connected with the shaft body, and an other end of the elastic component is connected with the rod piece; when the rod piece is not in contact with the circuit board, the stop portion abuts on the lower end of the shaft body, wherein when the shaft body is pressed, the rod piece protruding from the third opening touches the circuit board through the second opening of the housing, and an elastic deformation force of the elastic component is applied to the shaft body in a direction parallel to the release direction.

6. The key structure according to claim 4, further comprising:

a circuit board, wherein one end of the housing is arranged on the circuit board; and an elastic component, arranged in the receiving portion of the shaft body, wherein one end of the elastic component is connected with the shaft body, and an other end of the elastic component protrudes from the third opening of the receiving portion of the shaft body, wherein when the shaft body is pressed, the elastic component protruding from the third opening touches the circuit board through the second opening of the housing, and an elastic deformation force of the elastic component is applied to the shaft body in a direction parallel to the release direction.

7. The key structure according to claim 2, further comprising:

a circuit board, wherein one end of the housing is arranged on the circuit board;

an elastic component, arranged on the bottom portion of the housing, abutting on a lower end of the shaft body, and electrically connected to the circuit board; and a conductive structure, arranged on the bottom portion of the housing, and electrically connected to the circuit board, wherein when the shaft body is not pressed, the elastic component and the conductive structure are separated from each other;

when the shaft body is pressed, the elastic component is pressed to touch the conductive structure; an elastic deformation force from the pressed elastic component is applied to the shaft body in a direction parallel to the release direction.

8. The key structure according to claim 1, wherein a magnetization direction of the first magnetic component is opposite to a magnetization direction of the second magnetic component.

9. The key structure according to claim 1, wherein the second magnetic component comprises:

a first magnetic subunit;

a second magnetic subunit; and a switch, wherein the first magnetic subunit and the second magnetic subunit are arranged on the switch, and the switch is arranged on the housing; the switch is configured to enable the first magnetic subunit and the second magnetic subunit to move relative to the first magnetic component, so that a center line of the first magnetic subunit is overlapped on the first magnetic component or a center line of the second magnetic subunit is overlapped on the first magnetic component;

a click ratio of the key structure in a state that the center line of the first magnetic subunit is overlapped on the first magnetic component is greater than a click ratio of the key structure in a state that the center line of the second magnetic subunit is overlapped on the first magnetic component; the click ratio provided by the key structure is a percentage of $(F_A-F_B)/F_A$, where $F_B$ is a contact force, and $F_A$ is an actuation force.

10. A key structure, comprising:

a housing, comprising a bottom portion and a top portion which are opposite to each other, and a first opening located at the top portion;

a shaft body, coupled with the housing through the first opening, wherein the shaft body is suitable for being pressed to move in a pressing direction;

a first magnetic component, arranged on the shaft body; and a second magnetic component, arranged on the housing, wherein the first magnetic component and the second magnetic component are aligned in an arrangement direction when the shaft body is not pressed, and an included angle between the arrangement direction and the pressing direction is greater than 0 degree and less than 180 degrees, the first magnetic component is arranged on a sidewall of the shaft body, and the first magnetic component is located between the second magnetic component and the sidewall.

11. The key structure according to claim 10, wherein the second magnetic component applies a magnetic force component in a release direction to the first magnetic component to provide a restoring force to the shaft body, and the release direction is opposite to the pressing direction.

12. The key structure according to claim 11, further comprising:

a circuit board, wherein one end of the housing is arranged on the circuit board;

an elastic component, arranged on the bottom portion of the housing, abutting on a lower end of the shaft body, and electrically connected to the circuit board; and a conductive structure, arranged on the bottom portion of the housing and electrically connected to the circuit board, wherein when the shaft body is not pressed, the elastic component and the conductive structure are separated from each other;

when the shaft body is pressed, the elastic component is pressed to touch the conductive structure; an elastic deformation force of the pressed elastic component is applied to the shaft body in a direction parallel to the release direction.

13. The key structure according to claim 11, wherein the housing further comprises a second opening located at the bottom portion; the shaft body further comprises a receiving portion; and the receiving portion of the shaft body has a third opening towards the second opening.

14. The key structure according to claim 13, further comprising:

a circuit board, wherein one end of the housing is arranged on the circuit board; and an elastic component, arranged in the receiving portion of the shaft body, wherein one end of the elastic component is connected with the shaft body, and an other end of the elastic component protrudes from the third opening of the receiving portion of the shaft body, wherein when the shaft body is pressed, the elastic component protruding from the third opening touches the circuit board through the second opening of the housing, and an elastic deformation force of the elastic component is applied to the shaft body in a direction parallel to the release direction.

15. The key structure according to claim 10, wherein an included angle between a magnetization direction of the first magnetic component and the pressing direction is greater than 0 degree and less than 180 degrees, and an included angle between a magnetization direction of the second magnetic component and the pressing direction is greater than 0 degree and less than 180 degrees.

16. The key structure according to claim 10, wherein the second magnetic component comprises:

a first magnetic subunit;

a second magnetic subunit; and a switch, wherein the first magnetic subunit and the second magnetic subunit are arranged on the switch, and the switch is arranged on the housing; the switch is configured to enable the first magnetic subunit and the second magnetic subunit to move relative to the first magnetic component;

a click ratio of the key structure provided by the first magnetic subunit is different from a click ratio of the key structure provided by the second magnetic subunit.

17. A key structure, comprising:

a housing, comprising a bottom portion and a top portion which are opposite to each other, and a first opening located at the top portion;

a shaft body, coupled with the housing through the first opening, wherein the shaft body is suitable for being pressed to move in a pressing direction;

a first magnetic component, arranged on the shaft body; and a second magnetic component, arranged on the housing, wherein when the shaft body is not pressed, an upper edge of the first magnetic component is higher than an upper edge of the second magnetic component, and when the shaft body is pressed, the upper edge of the first magnetic component is lower than the upper edge of the second magnetic component, wherein the first magnetic component is arranged on a sidewall of the shaft body, and the first magnetic component is located between the second magnetic component and the sidewall.

18. The key structure according to claim 17, wherein the second magnetic component applies a magnetic force component in a release direction to the first magnetic component to provide a restoring force to the shaft body, and the release direction is opposite to the pressing direction.

19. The key structure according to claim 18, wherein the housing further comprises a second opening located at the bottom portion; the shaft body further comprises a receiving portion; and the receiving portion of the shaft body has a third opening facing towards the second opening.

20. The key structure according to claim 19, further comprising:

a circuit board, wherein one end of the housing is arranged on the circuit board; and an elastic component, arranged in the receiving portion of the shaft body, wherein one end of the elastic component is connected with the shaft body, and an other end of the elastic component protrudes from the third opening of the receiving portion of the shaft body, wherein when the shaft body is pressed, the elastic component protruding from the third opening touches the circuit board through the second opening of the housing, and an elastic deformation force of the elastic component is applied to the shaft body in a direction parallel to the release direction.

21. The key structure according to claim 17, wherein a magnetization direction of the first magnetic component is opposite to a magnetization direction of the second magnetic component.

22. The key structure according to claim 17, wherein the second magnetic component comprises:

a first magnetic subunit;

a second magnetic subunit; and a switch, wherein the first magnetic subunit and the second magnetic subunit are arranged on the switch, and the switch is arranged on the housing; the switch is configured to enable the first magnetic subunit and the second magnetic subunit to move relative to the first magnetic component;

a click ratio of the key structure provided by the first magnetic subunit is different from a click ratio of the key structure provided by the second magnetic subunit.

23. The key structure according to claim 17, wherein the second magnetic component applies a magnetic repulsive force component in a release direction to the first magnetic component to provide a restoring force to the shaft body, and the release direction is opposite to the pressing direction.

24. The key structure according to claim 23, wherein an included angle between a magnetization direction of the first magnetic component and the pressing direction is greater than 0 degree and less than 180 degrees, and an included angle between a magnetization direction of the second magnetic component and the pressing direction is greater than 0 degree and less than 180 degrees.

* * * * *